US006132872A

United States Patent [19]

McIntosh et al.

[11] Patent Number: 6,132,872

[45] Date of Patent: Oct. 17, 2000

[54] LIGHTWEIGHT ABRASION RESISTANT BRAIDING

[75] Inventors: Bruce Murray McIntosh, Harrogate; Noel Anthony Briscoe, Dursley; Kevin James Artus, Abbeydale, all of United Kingdom

[73] Assignee: Zyex Limited, Gloucestershire, United Kingdom

[21] Appl. No.: 09/084,733

[22] Filed: May 26, 1998

[30] Foreign Application Priority Data

Jan. 27, 1998 [GB] United Kingdom ..... 9801560

[51] Int. Cl.[7] ..... D01F 6/66

[52] U.S. Cl. ..... 428/398; 428/376; 428/564; 139/383 A

[58] Field of Search ..... 428/398, 376, 428/364, 357; 139/383 A; 162/358.4, 348

[56] References Cited

U.S. PATENT DOCUMENTS

| | | | |
|---|---|---|---|
| 4,251,588 | 2/1981 | Goetemann et al. . | |
| 5,052,446 | 10/1991 | Gysin | 139/93 |
| 5,115,582 | 5/1992 | Westhead | 162/348 |
| 5,202,023 | 4/1993 | Trimmer et al. | 210/321.28 |
| 5,472,607 | 12/1995 | Mailvaggnam et al. | 210/490 |
| 5,573,039 | 11/1996 | Mang | 138/141 |
| 5,597,450 | 1/1997 | Baker et al. . | |
| 5,772,848 | 6/1998 | Dutt | 162/358.4 |

*Primary Examiner*—Newton Edwards
*Attorney, Agent, or Firm*—Merchant & Gould P.C.

[57] ABSTRACT

A hollow monofilament of a high temperature spinnable thermoplastic such as Polyetheretherketone (PEEK) which is substantially hollow by up to about 80% by volume and has an outer diameter in the range from about 0.07 to 0.80 mm. is used in the construction of braiding in substitution for solid monofilaments with the advantage of lower cost and increased abrasion resistance.

6 Claims, No Drawings

LIGHTWEIGHT ABRASION RESISTANT BRAIDING

BACKGROUND OF THE INVENTION

This invention relates to braiding of the type typically constructed of monofilament or multi-filament yarns braided together to form sleeves for protecting, typically, automotive or aircraft electrical wiring or tubing to prevent or inhibit abrasion thereof.

Braiding of the aforementioned type is generally made from individual strands or collections of strands overbraided with adjacent strands or sets of strands and made from high-grade polymers such as nylon. For high performance applications where, particularly, the diameter of the monofiament needs to be small such as in the diameter range of 0.07 mm to 0.80 mm to meet specific cover and performnance criteria of the braid, a polyaryletherketone such as polyetheretherketone (known as "PEEK") is typically used either by itself or in combination with other monofilaments made from less expensive polymers. A known property of PEEK is its superior resistance to abrasion and this is why it is a preferred material in safety critical applications such as in automobiles and aircraft. However the cost of PEEK monofilaments has always tended to mean that the material is only used when no other, cheaper, material can meet the performance characteristics required, particularly with regard to abrasion resistance and light weight relative to the amount of cover provided by the braid when the monofilament is within the diameter range indicated above.

Of the less expensive high temperature melt spinnable fibre forming thermoplastics which are also suitable for use in making braiding there is polyphenylene sulfide (known as "PPS"), polybutylene therapthalate (known as "PBT") and polyethylene napthalate (known as "PEN") as well as polyimides (known as "PET") and aliphatic polyketones (known as "PK") which can all be made up into solid monofilaments with which a braided object such as a tubular sleeve can be constructed.

A braided tubular sleeve can easily be expanded by being compressed along the length of the tube so as to fit easily over wiring or tubing to be protected and then the sleeve can be pulled along its length so that its diameter is reduced to fit snugly around the wiring or piping. Although tensile strength in the braid is of importance in that it must be sufficiently strong to resist normal wear and tear, nevertheless provided the tensile strength is sufficient to make the individual strands of filament substantially recoverable for the purposes of acting as a braid, as required, the very high tensile strength afforded by solid monofilaments of thermoplastics are, to a large extent, unnecessary.

In U.S. Pat. No. 4,251,588 issued to Goetmann et. al. hollow polymer monofilaments are described which are used in paper-making belts to provide improved dimensional stability and flexibility. The filaments are described as being prepared according to customary techniques for making hollow monofilaments where the molten thermoplastic polymer is extruded through a vented orifice die into a quench medium, after which it is orientated by being stretched from about 3.4 to 6.0 times the original length, resulting in the monofilaments generally having a void content of about from 3% to 15% of their cross-sectional area. It is stated that with a void content of less than about 3% little benefit over solid monofilament is realised and with a void content in excess of 15% the monofilament tends to lose its substantially circular cross-sectional configuration too readily and flattens to a substantially void-free filament.

These findings are confirmed in U.S. Pat. No. 5597450 issued to Baker et. al. where in a woven, heat set fabric, for use in a paper making and like machine, at least a portion of the weft strands are hollow thermoplastic polymer monofilaments having a solidity in their undeformed cross-sectional area from about 50% to about 80%. The circumference of the hollow filaments is greater than or equal to the perimeter of the weft passageways they are to occupy in the fabric after heat setting, the stated advantage being to ensure that air permeability is both low and uniformly constant throughout the woven fabric. A further stated advantage is that, because some of the monofilaments are hollow they have less mass than comparably sized solid monofilaments such that their inertia is lower, thereby reducing problems associated with the acceleration and deceleration of large diameter monofilaments on high speed weaving looms.

SUMMARY OF THE INVENTION

The present invention is derived from the surprising realisation that hollow monofilaments of thermoplastics can also be advantageously used in braiding in order to increase per unit mass the resistance to abrasion, this being the primary property required of the braiding.

According to the invention there is provided a lightweight abrasion resistant braid comprising or including monofilaments of spinnable thermoplastics in which each monofilament is substantially hollow by about up to 80% by volume and with outer diameters in the range from about 0.07 to 0.80 mm. Where the void fractions are between 10% to 40% of the cross-sectional area of the monofilament it has been found that abrasion resistance performance is at least as good, and in some instances much better than the abrasion resistance performance of solid strands of monofilament.

Preferably, the hollow monofilament is made of PEEK or any other suitably spinnable fibre forming thermoplastics material including PPS, PBT and PEN.

With void fractions of between 20% to 80% of the cross-sectional area of the hollow monofilament enhanced cover of the braid can be produced by which the monofilaments are flattened in final braiding to provide enhanced cover with optional post braiding treatments to heat set the flattened profiles into permanent high cover braiding having good surface abrasion resistance.

The invention therefore provides novel braiding using high cost polymers such as PEEK having properties at least as good but often significantly better than braiding made from solid monofilaments and with a consequent saving in cost and weight.

DETAILED DESCRIPTION OF THE INVENTION

PEEK hollow monofilaments were made using a conventional fibre melt spinning process using an annular extrusion die followed by quench, fibre drawing over heated rolls and hot plate relaxation before winding onto a spool. PEEK of intrinsic viscosity around 1.0 measured at 25° C. in a solution of 0.1 g. of the polymer in 100 ml. of concentrated sulphuric acid was melted in a single screw extruder at 380° C. and extruded between 2 to 15 g/min through a spinning pack containing multiple layers of metal mesh filter gauzes and an annular orifice die having a 4.4 mm outer diameter and a 2.2 mm inner diameter, with the central nozzle vented to atmosphere. The hollow filament was extruded and then drawn to between 2.5 and 3 times the original length before being reheated to 310° C. to 340° C. to give a relaxation ratio of up to 15% of the maximum drawn length before being wound onto a spool.

Monofilaments of PEEK produced under these conditions were circular, with good size and shape uniformity and gave diameters between 0.20 mm to 0.55 mm with a void content of around 25% of the cross-section of the monofilament. The weight per length of the hollow monofilaments were proportionally lower than for solid monofilaments of equivalent diameters.

Abrasion tests were then carried out on both hollow and solid monofilaments using a reciprocation method whereby individual strands of monofilament were repeatedly drawn over an alumina ceramic pin of diameter 3.12 mm at an angle of 90° under a tension of 3 Newtons at approximately 0.7 HZ. The stroke of the reciprocating action was approx. 30 mm and the ambient temperature was in the range 25° C.+3° C. In each case the number of cycles until failure by rupture of the filament was noted.

By way of example a PEEK hollow monofilament was produced under the process described previously using a polymer output of 5.4 g/min and a take up rate of 30 m/min, then conventionally drawn by hot rolls and finally re-heated and relaxed by about 15% of the maximum extended length of the filament. Various properties of the hollow monofilament were then measured and compared to corresponding properties of a conventional solid industrial PEEK monofilament of diameter 0.35 mm known and referred to as type Z 1110 manufactured by Zyex Limited specifically for weaving and braiding.

As in the first example, the PEEK hollow monofilament was produced under the process described previously using a polymer output of 4.0 g/min, take-up rate of 30.0 m/min and relaxation of 10%. This was compared to a conventional solid industrial PEEK monofilament of diameter 0.28 mm known and referred to as Type Z1220 manufactured by ZYEX Limited specifically for weaving and braiding.

The results of the comparison are shown in the Table below in which it will be seen that although the solid monofilament significantly out-performed the hollow monofilament in tenacity, extension to break and tensile factor, the reverse was the case when resistance to abrasion was measured with an approximately fourfold advantage being gained over the conventional solid monofilament.

This surprising result is believed to be due to the ability of the outer surface of the hollow monofilament to flex inwardly when mechanical pressure is applied as a result of the presence of the void so that the surface area being abraded is thereby increased and as a consequence the mechanical load caused by the abrasion is shared over a wider surface area.

This can be contrasted to the situation when a solid monofilament is abraded where, due to its inelastic nature and solidity, the abrasion is concentrated on a relatively small and unyielding part of the monofilament which is thereby abraded and damaged much more severely than the hollow monofilament which is able to yield under the pressure of abrasion.

Hollow monofilament from Example 2 was made up into a 16 strand plaited tubular braided sleeve with 3 ends per strand at a helix angle of 30° to the axis. The resultant braid had a linear density of 3.3 g/m. In a similar way a solid ZYEX monofilament braid based on 0.28 mm Z1220 was made in an identical construction. The resultant braid had a linear density of 4.4 g/m.

The resistance of these braids to abrasion was compared using the same reciprocating apparatus as described in Examples 1 and 2.

In some cases the absolute load, in other cases the angle over the pin and in others still the pin surface were changed. In addition, the braid was tested both with and without being fitted closely over an electrical cable to closely simulate real conditions of use and wear.

Both solid and hollow monofil braids were treated in exactly the same manner and loaded identically.

Surprisingly, there were no significant differences in the cycles to failure recorded for comparable cases. This indicates that there is effectively a 25% advantage in terms of protection for material used delivered by the hollow braid.

This is surprising in that the testing of single monofil samples would suggest the potential for much larger improvements.

The much greater degrees of freedom afforded by the braided structure presumably give rise to better relative load sharing than is available when single monofils are tested in a totally controlled manner.

Examination of the mode of failure of both hollow and solid monofilament braids during destructive testing also

TABLE

| MONO-FILAMENT | DIAMETER | % VOID | ABRASION TEST CYCLES | TENACITY (T) | EXTENSION TO BREAK (E) | TENSILE FACTOR ($TE^{1/2}$) |
|---|---|---|---|---|---|---|
| HOLLOW | 0.33 mm | 23 | 16,895 | 25.8 | 24.1% | 126 |
| SOLID | 0.35 mm | 0 | 4,224 | 34.0 | 38.0% | 209 |
| HOLLOW | 0.28 mm | 25 | 19,265 | 26.4 | 19.0% | 115 |
| SOLID | 0.28 mm | 0 | 6,652 | 37.1 | 28.2% | 197 |

$$\text{Where: Tenacity (T)} = \frac{\text{tensile load at break in centiNewtons}}{\text{linear density in tex}}$$

tex = mass per unit length in grams per 1000 metres $$\text{Extension to Break (tensile) (E)} = \frac{(\text{final length} - \text{initial length})}{\text{initial length}} \times 100$$

Tensile factor = $T \times E^{1/2}$ demonstrates that the mode of failure for each is very different. Solid monofilaments show smooth surface wearing at high points which is often followed by specific lateral fissures relative to the major axis of the monofilament which then leads rapidly to a brittle type of complete failure of the filament.

In the case of hollow monofilaments a lower level of surface wearing is detected which is followed by longitudinal fissures relative to the major axis of the monofilament which leads to a network of irregular fine fibre which gives a visible "felt like" appearance and thereafter takes a substantial additional time to suffer complete failure.

Hence, it will be appreciated that the hollow monofilament of the invention continues to act as a braid even after partial failure due to wear. An additional advantage following on from this over solid monofilaments of PEEK is that the latter tend to show little or no signs of wear prior to complete failure whereas the former provides an easily visible indication of wear as the wear progresses due to the appearance of longitudinal fissures which in some instances actually increase the level of cover of the braid as wear progresses. As such, wear of the braid is much easier to detect and correct such that in safety critical applications visual inspection can be a reliable indicator as to whether replacement of the braid is necessary or not.

The invention also provides a braid which has substantially more coverage than that of a braid using solid thermoplastics monofilaments in that where the braid is a tight fit over a part to be protected, such as tubing, the individual filaments tend to assume an elliptical cross-section and this property can even be permanently imparted to the braiding during manufacture thereof by means of heat treatment.

The invention therefore also provides a surprising and novel use for hollow PEEK monofilament in a particular application where resistance to abrasion is the required property, this property being greatly enhanced, even though it may be at the expense of some less important mechanical properties.

What we claim is:

1. A lightweight abrasion resistant braid comprising monofilaments of spinnable thermoplastics in which each monofilament is substantially hollow by up to 80% by volume and with outer diameters in the range from about 0.07 to 0.80 mm.

2. A braid according to claim 1 wherein each monofilament is substantially hollow by about between 10–80% by volume.

3. A braid according to claim 1 in which part or all of the monofilaments are made of polyaryletherketones.

4. A braid according to claim 1 in which part or all of the monofilaments are made of PEEK.

5. A monofilament for making a braid according to claim 1.

6. A monofilament for making a braid according to claim 2.

* * * * *